US010883373B2

(12) United States Patent
Hall et al.

(10) Patent No.: US 10,883,373 B2
(45) Date of Patent: Jan. 5, 2021

(54) BLADE TIP SEAL

(71) Applicant: Rolls-Royce Corporation, Indianapolis, IN (US)

(72) Inventors: Christopher Hall, Indianapolis, IN (US); M. Stephen Krautheim, Fountaintown, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 691 days.

(21) Appl. No.: 15/448,318

(22) Filed: Mar. 2, 2017

(65) Prior Publication Data

US 2018/0355732 A1 Dec. 13, 2018

(51) Int. Cl.
*F01D 5/20* (2006.01)
*F01D 11/12* (2006.01)

(52) U.S. Cl.
CPC ..... *F01D 5/20* (2013.01); *F01D 11/122* (2013.01); *F05D 2220/323* (2013.01); *F05D 2240/11* (2013.01); *F05D 2240/307* (2013.01); *F05D 2250/181* (2013.01); *F05D 2250/182* (2013.01)

(58) Field of Classification Search
CPC . F01D 5/20; F01D 11/08; F01D 11/12; F01D 11/122; F01D 11/125; F05D 2240/11; F05D 2240/307
USPC ..... 277/412, 415
See application file for complete search history.

(56) References Cited

U.S. PATENT DOCUMENTS 4,238,170 A 12/1980 Robideau et al.
4,682,933 A 7/1987 Wagner
4,738,586 A 4/1988 Harter
5,308,227 A * 5/1994 Gros ..... F01D 5/06 416/219 R
5,890,873 A * 4/1999 Willey ..... F01D 5/225 277/303
5,997,251 A * 12/1999 Lee ..... F01D 5/187 416/97 R
6,131,910 A * 10/2000 Bagepalli ..... F01D 5/225 277/355
6,578,849 B2 * 6/2003 Haje ..... F16J 15/164 277/389
6,755,619 B1 6/2004 Grylls et al.
(Continued)

FOREIGN PATENT DOCUMENTS

CN 103541777 A 1/2014
EP 1701004 9/2006
GB 2155558 * 3/1984

*Primary Examiner* — Kenneth J Hansen
*Assistant Examiner* — Brian O Peters
(74) *Attorney, Agent, or Firm* — Barnes & Thornburg LLP

(57) ABSTRACT

A blade tip sealing portion forms the distal end of a rotor blade in a turbine engine to reduce or prevent leakage through the blade tip clearance. A rotor assembly comprises a casing, a rotor, and at least one rotor blade coupled to the rotor. The rotor blade comprises a root portion coupled to the rotor, a main airfoil body extending radially from the root portion, and a blade tip sealing portion. The blade tip sealing portion comprises a blade tip platform and a plurality of sealing members. The sealing members are positioned on the blade tip platform at an angle substantially perpendicular to an air flow across the blade tip platform and are spaced to effect overlap of adjacent sealing members in the direction of the air flow.

14 Claims, 15 Drawing Sheets

(56) References Cited

U.S. PATENT DOCUMENTS

| | | | | |
|---|---|---|---|---|
| 6,916,021 | B2 * | 7/2005 | Beeck | F01D 5/225 277/411 |
| 7,549,841 | B1 | 6/2009 | Marussich | |
| 8,192,166 | B2 * | 6/2012 | Beeck | F01D 11/08 415/173.6 |
| 8,313,287 | B2 | 11/2012 | Little | |
| 9,713,912 | B2 * | 7/2017 | Lee | C23C 30/00 |
| 2004/0046327 | A1 * | 3/2004 | Menendez | F16J 15/3288 277/412 |
| 2011/0182719 | A1 * | 7/2011 | Deo | F01D 11/02 415/173.1 |
| 2012/0213631 | A1 | 8/2012 | Miller et al. | |
| 2012/0230818 | A1 * | 9/2012 | Shepherd | F01D 5/20 415/208.1 |
| 2013/0017072 | A1 * | 1/2013 | Ali | F01D 11/02 415/174.4 |
| 2016/0010560 | A1 | 1/2016 | Dierksmeier | |

* cited by examiner

BLADE TIP SEAL

FIELD OF THE DISCLOSURE

The present invention relates generally to rotor assemblies having a casing around a rotor and blades such as a fan, compressor, or turbine in a gas turbine engine and, more specifically, to sealing the clearances between the blade tip and casing in such rotor assemblies.

BACKGROUND

In a turbomachine such as a gas turbine engine, air acts as the working fluid and is compressed by a fan, a compressor, or a combination of the fan and compressor. The compressed air is mixed with fuel and combusted in a combustor, and the combustion gases are expanded through a turbine to extract energy. The extracted energy may be used, for example, to generate electricity or to rotate one or more shafts which may be coupled to the fan and/or compressor. In applications where the turbine engine is providing motive force to a vehicle such as an aircraft, combustion gases may additionally be ejected from the turbine to provide thrust.

Each of the fan, compressor, and turbine comprise one or more sets of blades attached about a rotatable shaft or a disc which is coupled to a rotatable shaft. During operation, the blades rotate with the shaft or disc. In the fan and compressor, the rotation of the blades increases the pressure of the air; conversely, in the turbine the rotation of the blades decreases the pressure of the combustion gases and extracts work.

Each set of blades is typically circumferentially encased by an engine casing or a shroud. FIG. 1 is a schematic and sectional view of a portion of a blade 101 and casing 103. Due to various operational transients such as but not limited to blade and case expansion, maneuver deflections, transient overshoot, bearing and damper clearances, general part tolerances, and axial excursions, blades are typically designed with a blade tip clearance 105. A blade tip clearance 105 is a gap between the radially inner surface 107 of the casing 103 and the tip 109 of a blade 101. Blade tip clearance 105 may be calculated as the radius of the inner surface 107 minus the radius of the blade tip 109.

Although blade tip clearances 105 are a preferred method of preventing contact between the blade tip and the casing (commonly referred to as "rub"), which can lead to damage of the blade and/or casing and even engine failure, blade tip clearances 105 are problematic in that they result in leakage from a relatively high pressure side of a blade to a relatively low pressure side of a blade during operation. Stated differently, air or combustion gases may leak from the pressure side of the blade to the suction side of the blade. Such leakage generally decreases the efficiency of the fan, compressor, and/or turbine, and may in some applications result in decreased stall margin. The magnitude of the tip clearance relative to the spanwise dimension of the airfoil expressed as a percentage can be termed the clearance to span ratio. A change in tip clearance for a large clearance to span ratio, such as at the rear of a compressor, will be more impactful to the efficiency aforementioned.

It is thus desirable to provide a system and method of reducing leakage across the blade tip 109 while ensuring that a rotating blade 101 does not contact the casing 103 in a manner that will cause damage to the engine. Reducing blade tip leakage would increase the efficiency of the fan, compressor, and/or turbine, and may in some applications result in increased stall margin. Further, reducing blade tip leakage may additionally allow for the optimizing of additional aero and mechanical requirements such as flow, pressure ratio, weight, and cost, among other variables.

The present application discloses one or more of the features recited in the appended claims and/or the following features which, alone or in any combination, may comprise patentable subject matter.

SUMMARY

According to aspects of the present disclosure, a rotor assembly comprises a casing, a rotor, and at least one rotor blade. The rotor is encased by the casing. The at least one rotor blade is coupled to the rotor and comprises a root portion coupled to the rotor, a main airfoil body extending radially from the root portion, and a blade tip sealing portion forming the distal end of the rotor blade. The airfoil body comprises a pressure side surface and a suction side surface joined at and extending between a leading edge and a trailing edge. The blade tip sealing portion comprises a blade tip platform and a plurality of sealing members. The blade tip platform faces the casing and extends at least between the distal edges of the pressure side surface and the suction side surface of said main airfoil body. The plurality of sealing members extend radially from the blade tip platform. The sealing members are positioned on the blade tip platform to extend between a pressure side edge and a suction side edge at an angle substantially perpendicular to an air flow across the blade tip platform and are spaced between the leading edge and the trailing edge of the main airfoil body to effect overlap of adjacent sealing members in the direction of the air flow.

In some embodiments the sealing members are positioned to effect greater spacing between the members near the edges of the blade relative to the spacing between members near the mid-chord of the blade. In some embodiments the sealing members are positioned to effect greater spacing between the members near the mid-chord of the blade relative to the members near the edges of the blade. In some embodiments the plurality of sealing members have a uniform radial dimension. In some embodiments the plurality of sealing members have a differing radial dimension. In some embodiments each of the plurality of sealing members have a varying radial dimension along the length thereof. In some embodiments the elongated sealing members are positioned to effect uniform spacing between the members along the blade tip chord. In some embodiments the elongated sealing members are positioned to effect non-uniform spacing between the members along the blade tip chord.

According to other aspects of the present disclosure, in a rotor assembly having a casing, a rotor encased by the casing, and a rotor blade coupled to the rotor having a blade tip spaced from the casing, a method of reducing a tip leakage air flow between the blade tip and the casing from a pressure side of the rotor blade to a suction side of the rotor blade during rotation of the rotor comprises determining a primary direction of the tip leakage air flow relative to a blade tip chord; and positioning a plurality of elongated sealing members on a radially outward facing surface of the blade tip, the sealing members being positioned at an angle substantially perpendicular to the primary direction of the tip leakage air flow and being spaced along the blade tip chord to effect overlap of adjacent sealing members in the direction of the tip leakage air flow.

In some embodiments the method further comprises positioning a blade tip platform over the blade tip, the blade tip platform having a surface facing the casing and extending at least between the distal edges of the pressure side and suction side of the blade and from the midchord toward the leading edge and trailing edge of the blade. In some embodiments the blade tip platform extends to the leading edge and trailing edge of the blade. In some embodiments the elongated sealing members are positioned to effect uniform spacing between the members along the blade tip chord. In some embodiments the elongated sealing members are positioned to effect non-uniform spacing between the members along the blade tip chord. In some embodiments the elongated sealing members are positioned to effect greater spacing between the members near the edges of the blade relative to the spacing between members near the mid-chord of the blade. In some embodiments the elongated sealing members are positioned to effect greater spacing between the members near the mid-chord of the blade relative to the members near the edges of the blade.

In some embodiments the plurality of elongated sealing members have a uniform radial dimension. In some embodiments the plurality of elongated sealing members have a differing radial dimension. In some embodiments the plurality of elongated sealing members each have a varying radial dimension along the length thereof. In some embodiments the method further comprises providing an abradable region on the casing adjacent the blade tip; dimensioning the sealing members in the radial direction to effect contact between at least a portion of each sealing member and the abradable region; and rotating the rotor to effect rub between the plurality of sealing members and the abradable region, wherein the rub causes a plurality of annular channels to be formed in the abradable region with each one of the plurality of annular channels corresponding to a respective one of the plurality of sealing members.

According to yet further embodiments of the present disclosure, in a rotor assembly having a casing, a rotor encased by the casing, and a rotor blade coupled to the rotor having a blade tip spaced from the casing, a method is presented of reducing a tip leakage air flow between the blade tip and the casing from a pressure side of the rotor blade to a suction side of the rotor blade during rotation of the rotor. The method comprises positioning a blade tip platform over the blade tip, the blade tip platform having a surface facing the casing and extending at least between the distal edges of the pressure side and suction side of the blade and between the leading edge and trailing edge of the blade; positioning a plurality of elongated sealing members on the surface of the blade tip platform having a selected lateral cross-sectional shape, the sealing members being positioned at a selected angle relative to the blade tip chord and being spaced in a selected chord-wise spacing pattern along the blade tip chord; determining the flow rate and direction of the tip leakage airflow; and varying one or more of the selected lateral cross-sectional shape, the selected angle relative to the blade tip chord, and the selected chord-wise spacing pattern to effect a change in the flow rate of the tip leakage air flow.

BRIEF DESCRIPTION OF THE DRAWINGS

The following will be apparent from elements of the figures, which are provided for illustrative purposes and are not necessarily to scale.

Figure 1:
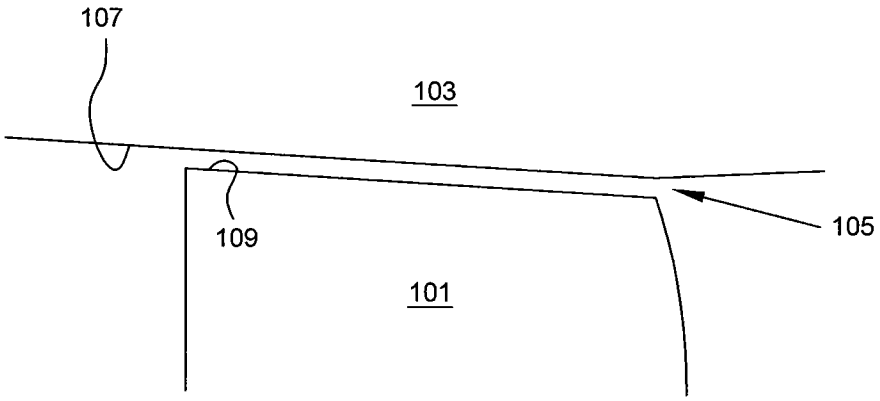
FIG. 1 is a schematic and sectional view of a portion of a blade and casing of a turbine engine.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION

For the purposes of promoting an understanding of the principles of the disclosure, reference will now be made to a number of illustrative embodiments illustrated in the drawings and specific language will be used to describe the same.

This disclosure presents embodiments to overcome the aforementioned deficiencies in fan, compressor, and turbine blades of a turbine engine. More specifically, the present disclosure is directed to systems and methods for reducing or eliminating leakage through the blade tip clearance. The present disclosure is directed to sealing mechanisms for the clearance between the blade tip and casing in a fan, compressor, or turbine of a turbine engine.

Figure 2:
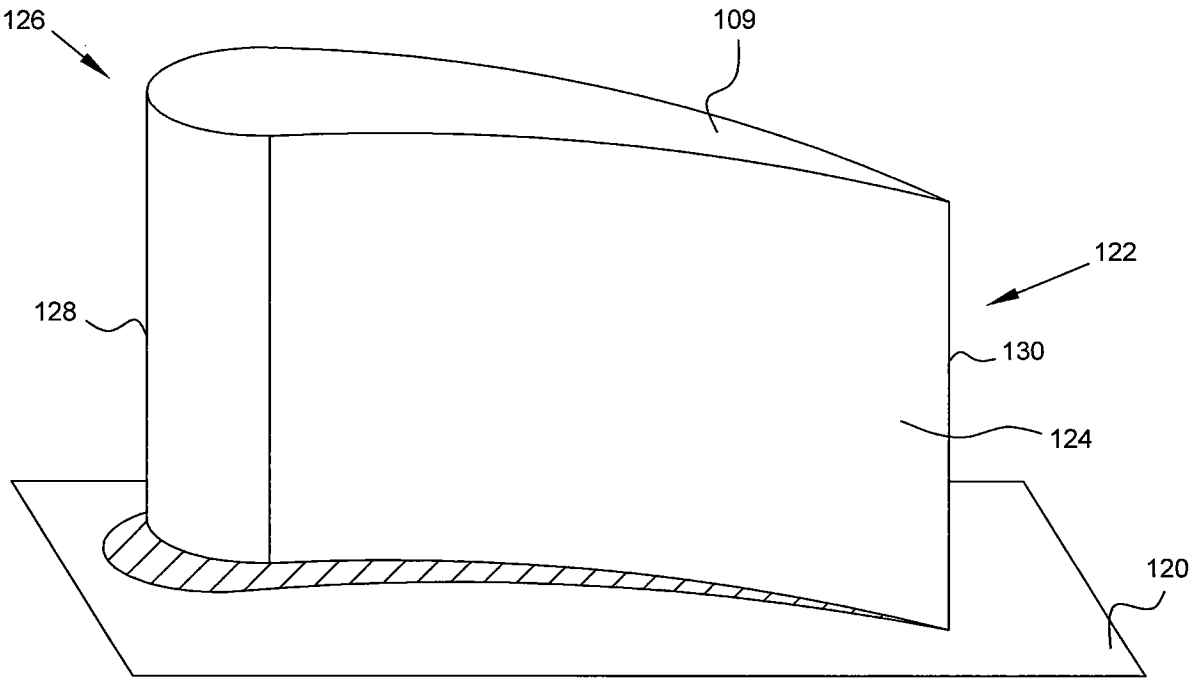
FIG. 2 is an isometric view of a blade of a turbine engine.

FIG. 2 is an isometric view of a blade 101 of a turbine engine. Blade 101 comprises a root portion 120 and a main airfoil body 122. Root portion 120 may be configured to engage a rotor or other shaft and disc assembly. The main airfoil body 122 extends radially outward from the root portion 120 and terminates at a distal end in the blade tip 109. The airfoil body 122 comprises an first side surface 124 and a second side surface 126, each of which extend between a leading edge 128 and trailing edge 130. In some embodiments, as when the present disclosure is applied to a blade 101 of a turbine, the first side surface 124 is a pressure side surface and the second side surface 126 is a suction side surface. In other applications the location of the pressure and suction sides may be reversed.

Figure 3:
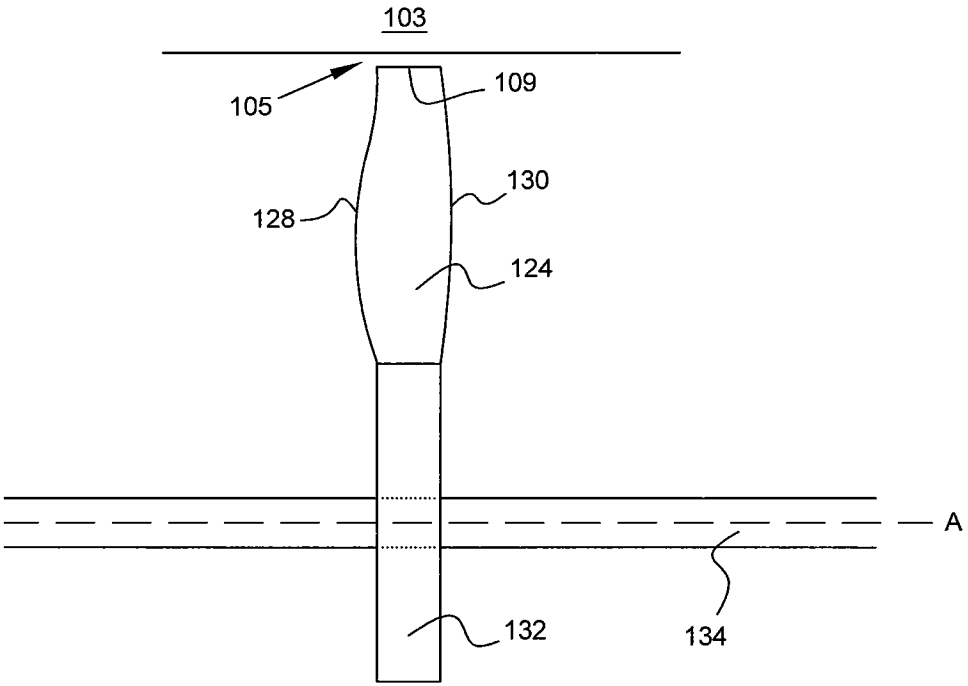
FIG. 3 is a schematic and sectional view of a rotor assembly having a blade encased in a casing of a turbine engine.

FIG. 3 is a schematic and sectional view of a blade 101 of a turbine engine encased by a casing 103. The structure illustrated in FIG. 3 may be referred to as a rotor assembly, which comprises casing 103, a rotor 132 encased by the casing 103, and at least one rotor blade 101 coupled to rotor 132. Blade 101 is coupled to a rotor 132 or disc that is coupled to a rotatable shaft 134. The blade tip 109 is spaced radially inward from the casing 103, resulting in a blade tip clearance 105 or gap between the blade tip 109 and casing 103. An axis of rotation for the rotatable shaft 134, rotor 132, and blade 109 is depicted as dashed line A.

Figure 4A:
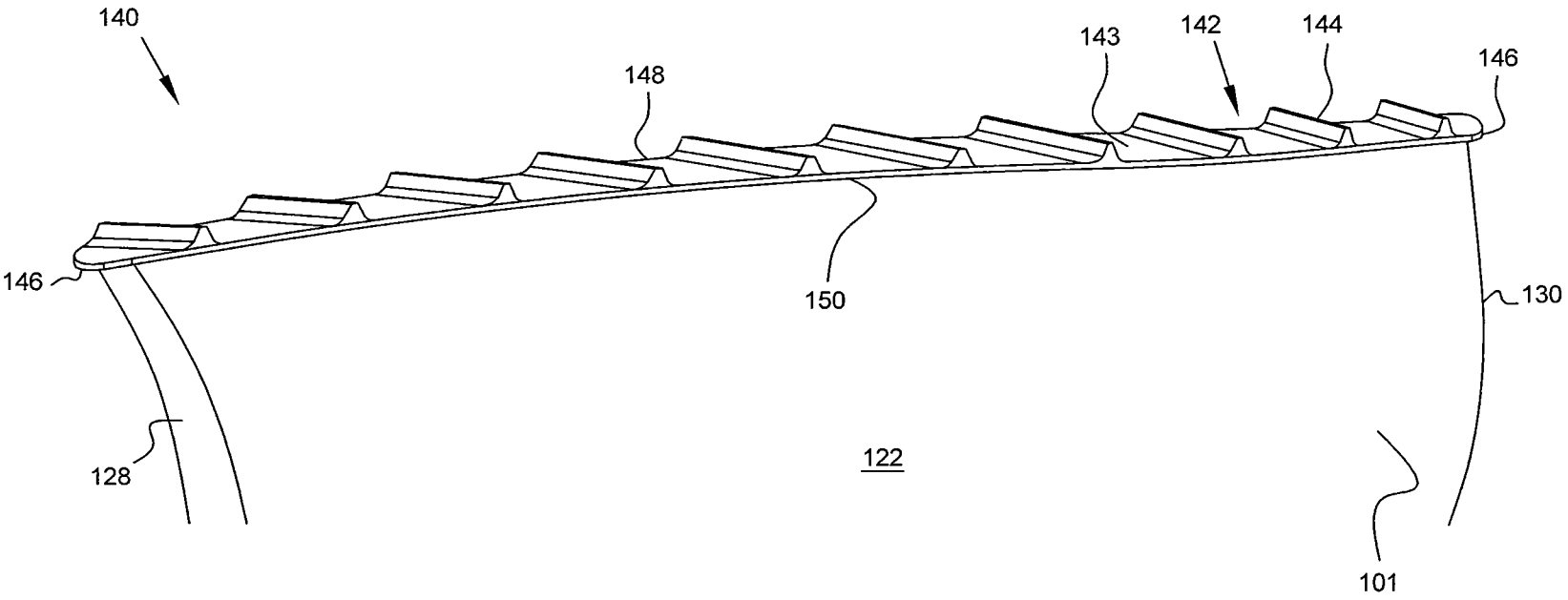
FIGS. 4A and 4B are isometric views of a blade tip sealing portion that forms the distal end of a blade of a turbine engine in accordance with some embodiments of the present disclosure.
Figure 4B:
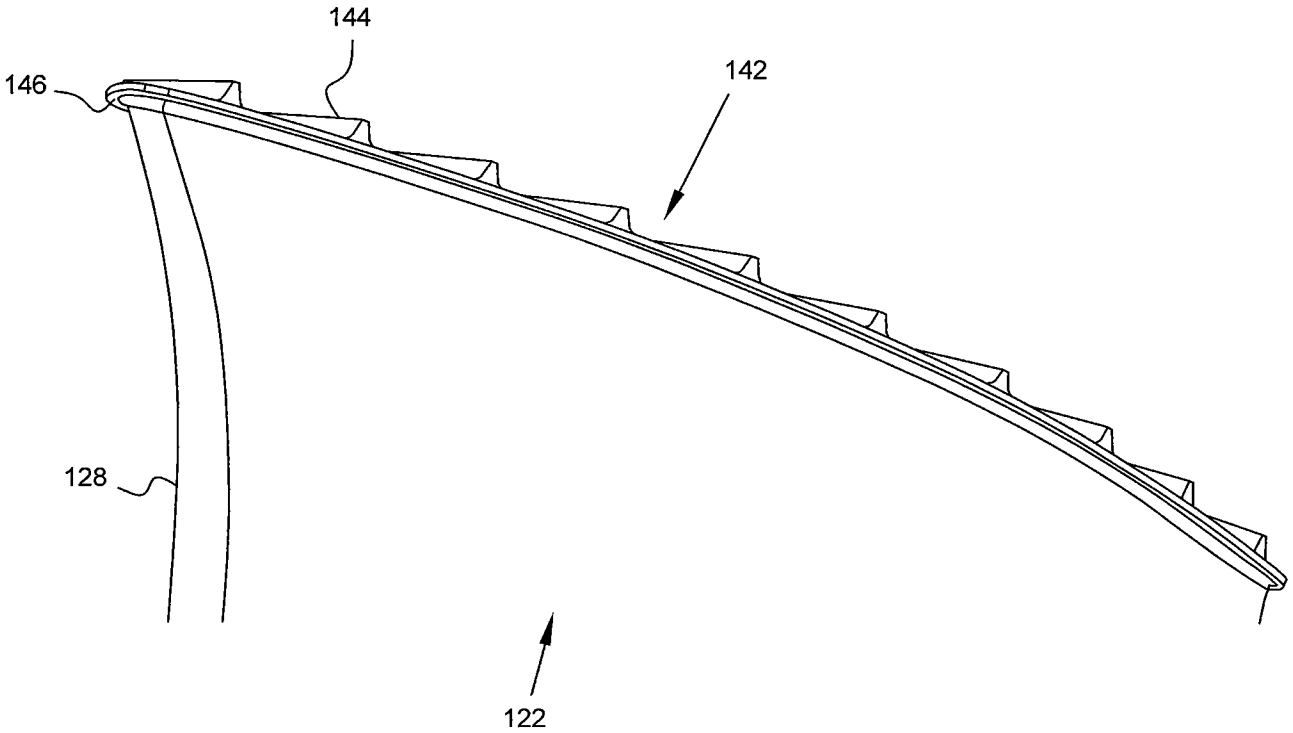

FIGS. 4A and 4B present isometric views of the blade tip sealing portion 140 that forms the distal or radially outward end of a blade 101. Blade tip sealing portion 140 comprises a blade tip platform 142 and a plurality of sealing members 144 extending from the blade tip platform 142.

Blade tip platform 142 comprises a surface 143 that faces the casing 103 and extends at least between the distal edges of the second side surface 126 and the first side surface 124 of said main airfoil body 122. In some embodiments blade tip platform 142 comprises a flange 146 or lip that extends beyond leading edge 128, trailing edge 130, first side surface 124, and/or second side surface 126. In addition to providing support for the plurality of sealing members 144, blade tip platform 142 improves the stiffness or rigidity of blade tip 109, with improved performance of the blade 101 in regards to resistance of bending and untwist. In some embodiments blade 101 and blade tip platform 142 are integrally formed.

A plurality of sealing members 144 extend radially outward from blade tip platform 142. Sealing members 144 may be referred to as ridges, rails, or protrusions. In some embodiments sealing members 144 may be elongate structures positioned on surface 143 of blade tip platform 142 and extending between the distal edges of first side surface 124 and second side surface 126. As explained further below with reference to FIGS. 9A and 9B, the plurality of sealing members 144 may be positioned on the blade tip platform 142 to extend between a pressure side edge 148 and a suction side edge 150 at an angle substantially perpendicular to an air flow leakage across the blade tip platform 142. The plurality of sealing members 144 may also be spaced between the leading edge 128 and the trailing edge 130 of the main airfoil body 122 to effect overlap of adjacent sealing members 144 in the direction of the air flow.

Figure 12:
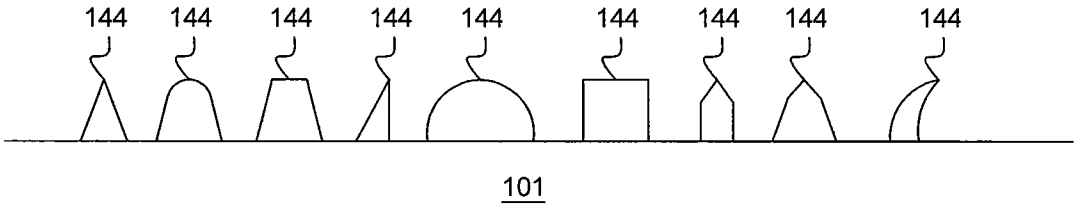
FIG. 12 is a schematic and sectional view of sealing members of a blade tip sealing portion having varying geometries in accordance with some embodiments of the present disclosure.
Figure 13:
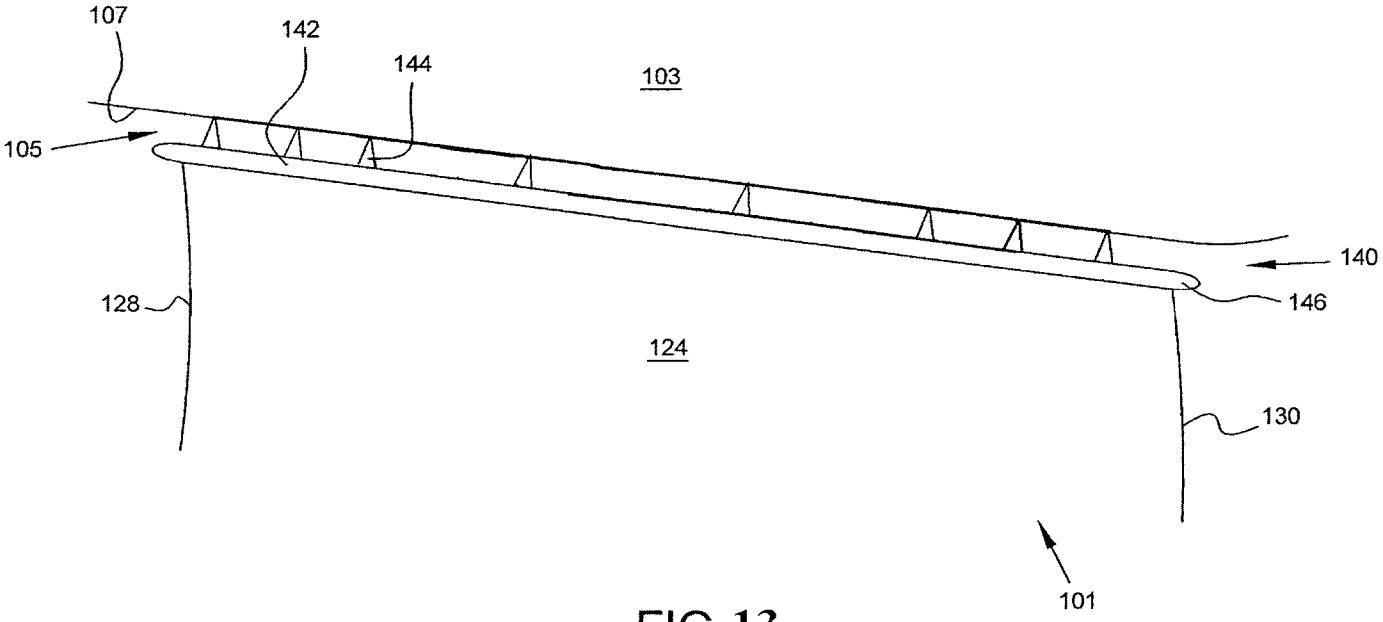
FIG. 13 is a schematic and sectional view of sealing members of a blade tip sealing portion configured to contact the radially inner surface of a casing in accordance with some embodiments of the invention.

The height, spacing, angle (relative to the axis of rotation or relative to a pressure side or suction side of the blade), thickness, and quantity of sealing members 144 may be optimized based on the specific application of the disclosed blade tip sealing portion 140. Sealing members 144 may have any number of shapes, profiles, heights, circumferential widths, spacing, and variability of geometries along the blade tip. Some examples of the lateral cross-sectional shapes of the members are shown in FIG. 12. In some embodiments the sealing members 144 further comprise a high temperature coating. In some embodiments, such as that shown in FIGS. 4A and 4B, sealing members 144 are spaced equally along the chord of the blade tip 109, are similarly shaped as rounded ridges, and are identically angled relative to an axis of rotation or a primary leakage vector.

In some embodiments sealing members 144 are positioned on surface 143 to effect uniform spacing between the members 144 along the blade tip chord. In other embodiments sealing members 144 are positioned on surface 143 to effect non-uniform spacing between the members 144 along the blade tip chord.

In some embodiments sealing members 144 are positioned on surface 143 to effect greater spacing between the members 144 near the leading edge 128 and trailing edge 130 relative to the spacing between members 144 near the mid-chord of blade tip 109. In some embodiments sealing members 144 are positioned on surface 143 to effect greater spacing between the members 144 near the mid-chord of blade tip 109 relative to the spacing between members 144 near the leading edge 128 and trailing edge 130.

In some embodiments sealing members 144 positioned on surface 143 have a uniform radial dimension and lateral cross-sectional shape. In other embodiments sealing members 144 positioned on surface 143 have a non-uniform or differing radial dimension and lateral cross-sectional shape. In some embodiments sealing members 144 positioned on surface 143 have a uniform radial dimension along the length of the sealing members 144. In other embodiments sealing members 144 positioned on surface 143 have a non-uniform or varying radial dimension along the length of the sealing members 144.

Figure 5:
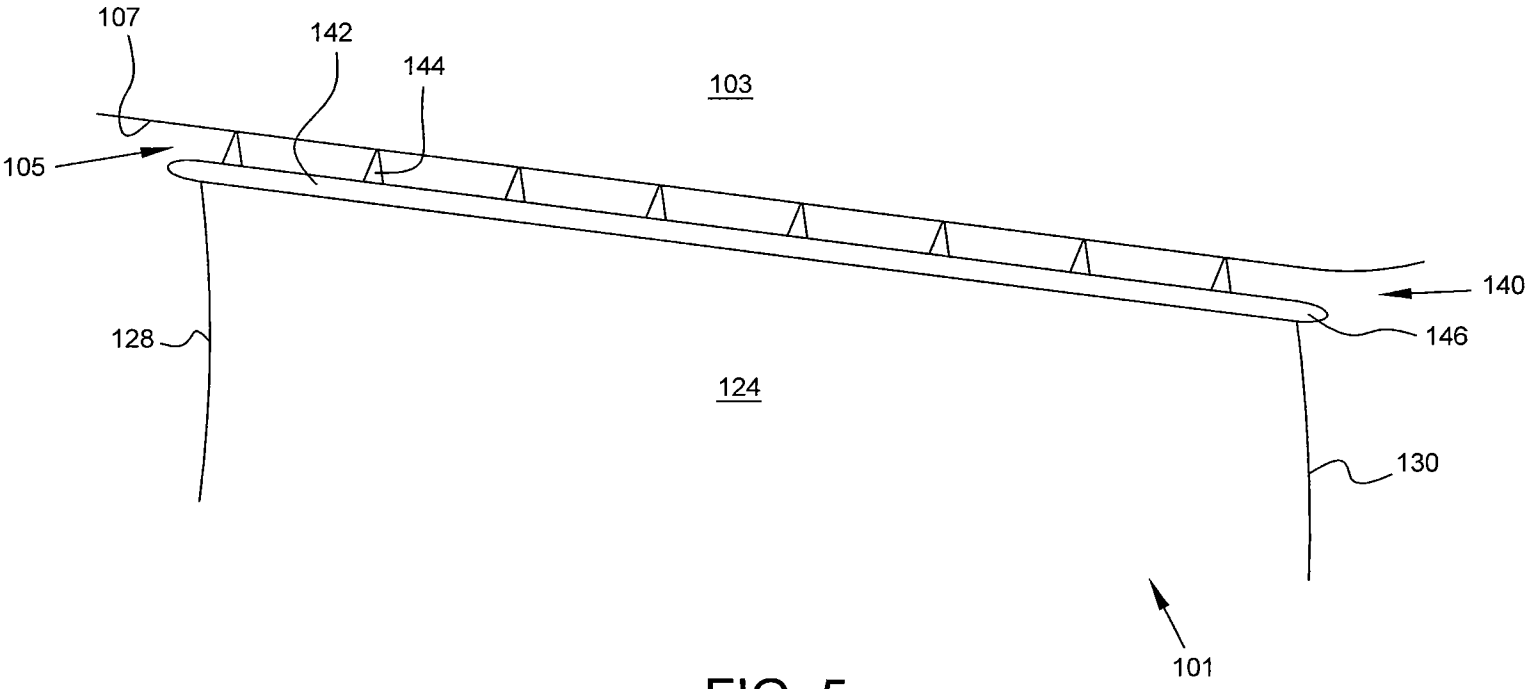
FIG. 5 is a schematic and sectional view of sealing members of a blade tip sealing portion configured to contact the radially inner surface of a casing in accordance with some embodiments of the present disclosure.

In some embodiments the sealing members 144 of a blade tip sealing portion 140 are configured to contact the radially inner surface of casing 103. FIG. 5 is a schematic and sectional view of such an embodiment. In FIG. 5, sealing member 144 are shown extending from the blade tip platform 142 to the casing 103. In other words, the sealing member 144 extend fully across the blade tip clearance 105. By contacting the casing 103, the sealing members 144 form a seal between the blade 101 and casing 103 and therefore reduce or eliminate leakage through the blade tip clearance 105.

Figure 6:
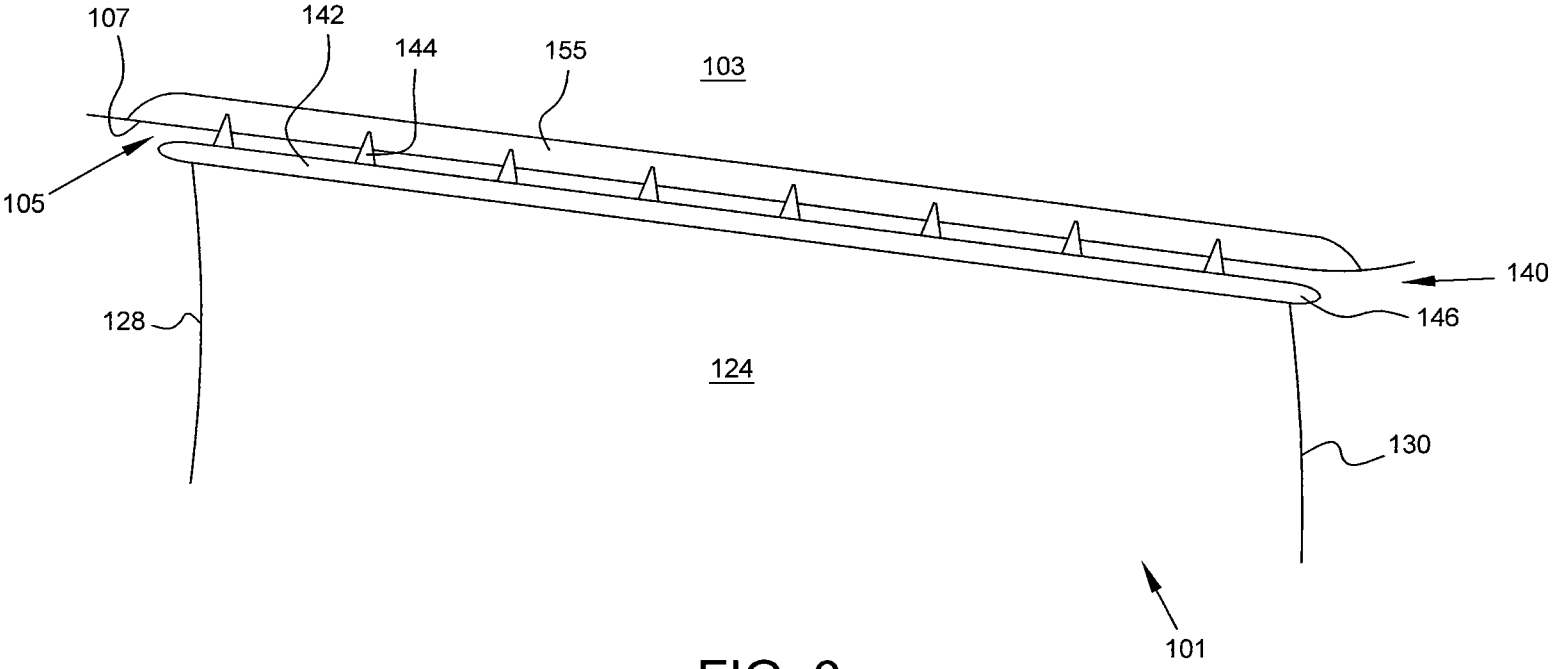
FIG. 6 is a schematic and sectional view of sealing members of a blade tip sealing portion configured to extend into and contact an abradable region of the casing in accordance with some embodiments of the present disclosure.

In some embodiments, the sealing members 144 of a blade tip sealing portion 140 are configured to extend into and contact an abradable region 155 of the casing 103. FIG. 6 is a schematic and sectional view of such an embodiment. In FIG. 6, sealing member 144 are shown extending from the blade tip platform 142 into an abradable region 155. The abradable region 155 forms a portion of the casing 103 radially outward from blade 101. In some embodiments, abradable region 155 may be replaced with a metallic honeycomb seals that have improved performance at high temperatures. In some embodiments the honeycomb seals comprise a high temperature coating.

As the blade 101 rotates during operation of the turbine engine, sealing members 144 contacting the abradable region 155 will likely rub annular pathways into the abradable region 155 that correspond to each sealing member 144. Contact between the abradable region 155 of casing 103 and one or more sealing members 144 forms a seal that reduces or eliminates leakage through the blade tip clearance 105.

In some embodiments such as that illustrated in FIG. 6, an existing fan, compressor, and/or turbine configuration is modified to include blade tip sealing portion 140. In such an embodiment, the blade tip clearance 105 need not be modified or reduced. Rather, the blade tip sealing portion 140 may be included with a blade 101 such that blade tip clearance 105 is substantially sealed by the blade tip sealing portion 140.

Figure 7:
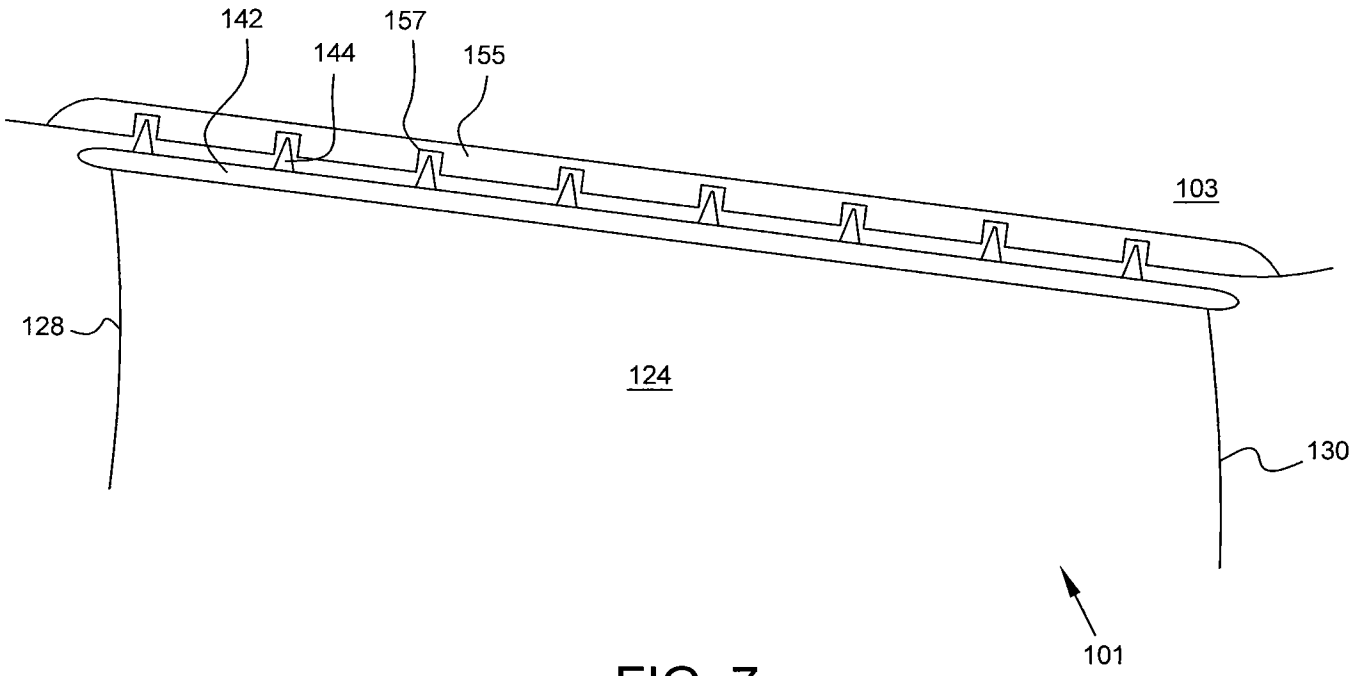
FIG. 7 is a schematic and sectional view of sealing members of a blade tip sealing portion extending into annular channels pre-formed in an abradable region of the casing in accordance with some embodiments of the present disclosure.

In some embodiments sealing members 144 may extend into annular channels 157 pre-formed in an abradable region 155 of casing 103 and/or the casing 103 itself. FIG. 7 is a schematic and sectional view of such an embodiment. As seen in FIG. 7, an abradable region 155 forms a portion of casing 103 radially outward from blade 101. The abradable region 155 in this embodiment comprises a plurality of annular channels 157, with each channel 157 corresponding to a respective one of a plurality of sealing members 144. Each sealing member 144 extends radially outward from the blade tip sealing platform 142 into a respective channel 157 of the abradable region 155. In some embodiments, at least a portion of a sealing member 144 contacts at least a portion of the abradable region 155, thereby forming a seal that reduces or eliminates leakage through blade tip clearance 105. In other embodiments, the configuration of sealing members 144 and channels 157 forms a torturous flowpath that reduces leakage through the blade tip clearance 105.

In implementing the embodiment of FIG. 7, care must be taken in that any axial excursion of the blade 101 could cause sealing members 144 to rub and widen the annular channels 157. This widening could degrade the effectiveness of blade tip sealing portion 140. Axial excursions could be caused, for example, by untwisting of blade 101, shifts in axial position by the rotatable shaft 134 or rotor 132, surges, and the like.

Figure 8:
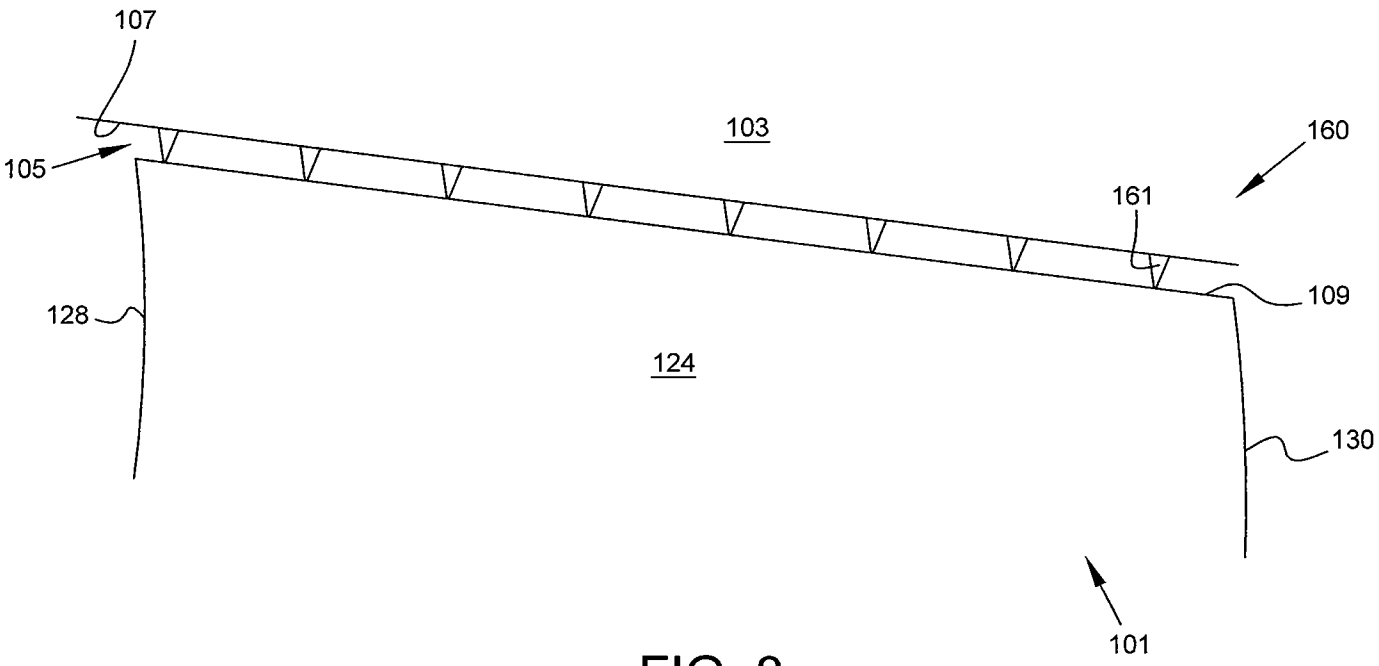
FIG. 8 is a schematic and sectional view of a plurality of sealing members extending radially inward from the casing to contact the blade tip, in accordance with some embodiments of the present disclosure.

In some embodiments a plurality of sealing members 161 extend radially inwardly from the radially inner surface 107 of the casing 103. FIG. 8 is a schematic and sectional view of such an embodiment. In FIG. 8, a blade tip sealing portion 160 comprises a plurality of sealing members 161 that extend from the casing 103 to the blade tip platform 142. Sealing members 161 are configured to contact the blade tip 109 of blade 101. In other words, the sealing members 161 extend fully across the blade tip clearance 105. By contacting the blade tip 109, the sealing members 161 form a seal between the blade 101 and casing 103 and therefore reduce or eliminate leakage through the blade tip clearance 105.

Figure 10:
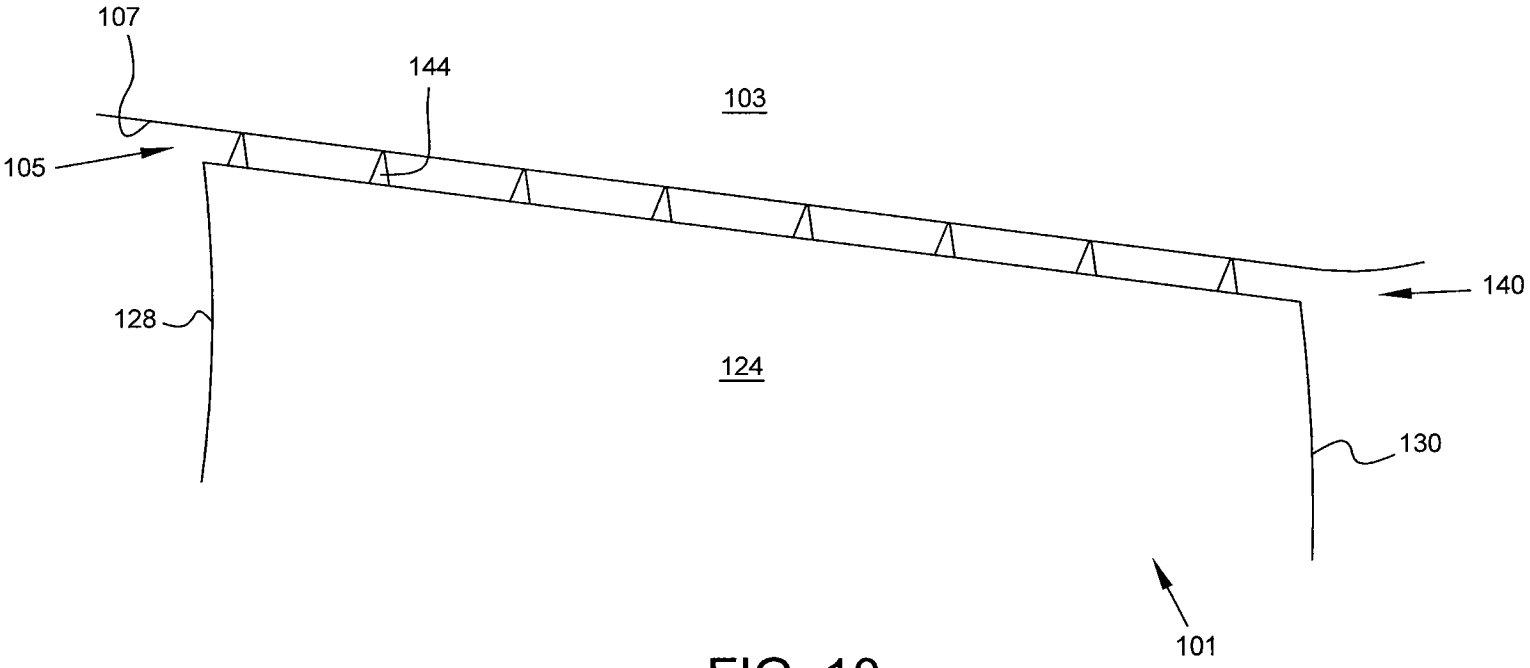
FIG. 10 is a schematic and sectional view of sealing members of a blade tip sealing portion configured to contact the radially inner surface of a casing in accordance with some embodiments of the present disclosure.

In some embodiments, a blade tip sealing portion 140 comprises a plurality of sealing members 144 as illustrated in FIG. 10. The plurality of sealing members 144 may extend from the tip 109 of the blade 101, and the blade tip platform may be omitted. In some embodiments the plurality of sealing members 144 extend from a radially outward facing surface of the blade 101 or blade tip 109.

Figure 11:
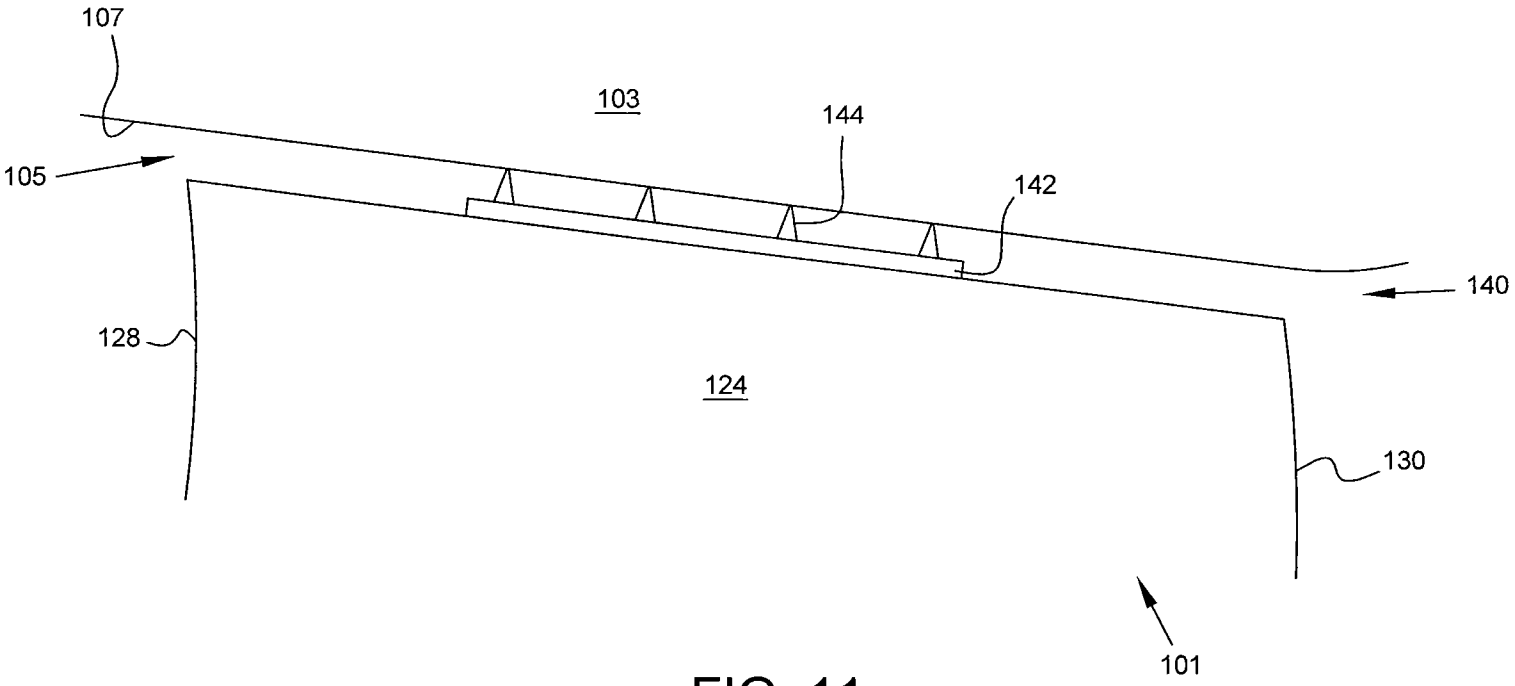
FIG. 11 is a schematic and sectional view of sealing members of a blade tip sealing portion configured to contact the radially inner surface of a casing in accordance with some embodiments of the present disclosure.

In some embodiments, such as that illustrated in FIG. 11, the blade tip sealing portion 140 may extend chordwise from the midchord in the direction of the leading edge 128 and trailing edge 130 but not extend fully to the leading edge 128 and/or trailing edge 130. In other words, the blade tip sealing portion 140 may be chordwise limited and may not extend from the leading edge 128 to the trailing edge 130.

Figure 9A:
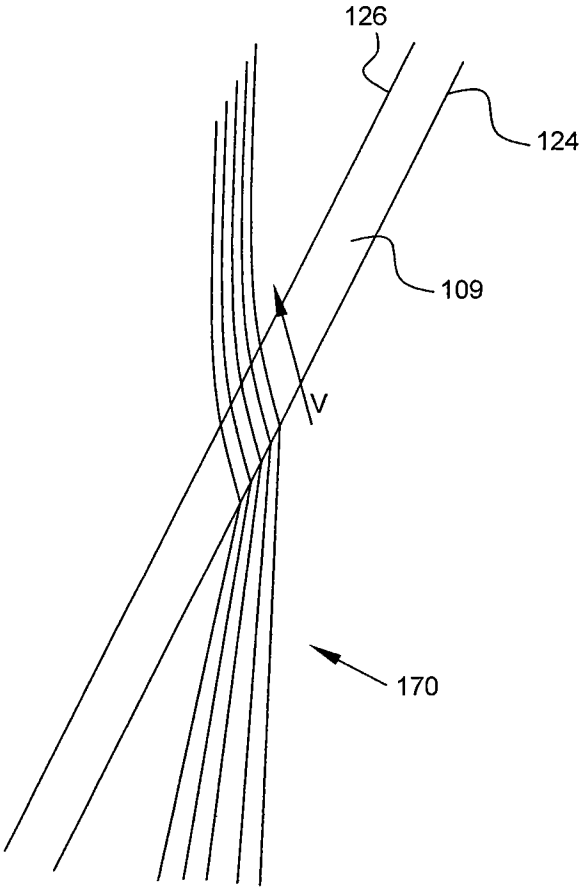
FIGS. 9A and 9B are profile views of a blade tip in accordance with some embodiments of the present disclosure.

In some embodiments, sealing members 144 may be positioned substantially perpendicular to a primary leakage vector V, or substantially perpendicular to a primary direction of the tip leakage air flow indicated by the direction of arrow V. FIG. 9A is a profile view of a portion of a blade tip 109, illustrating a plurality of leakage vectors from a pressure side 124 to a suction side 126 across the blade tip 109. FIG. 9A shows a plurality of leakage streams 170 that cross over the blade tip 109 (i.e. pass through the blade tip clearance 105) with the steams 170 having a common vector (indicated by arrow V) or at a minimum in a common direction (the direction indicated by arrow V). In some embodiments, a primary direction of tip leakage air flow is determined relative to the blade tip chord. In some embodiments a leakage flow rate is also determined.

Figure 9B:
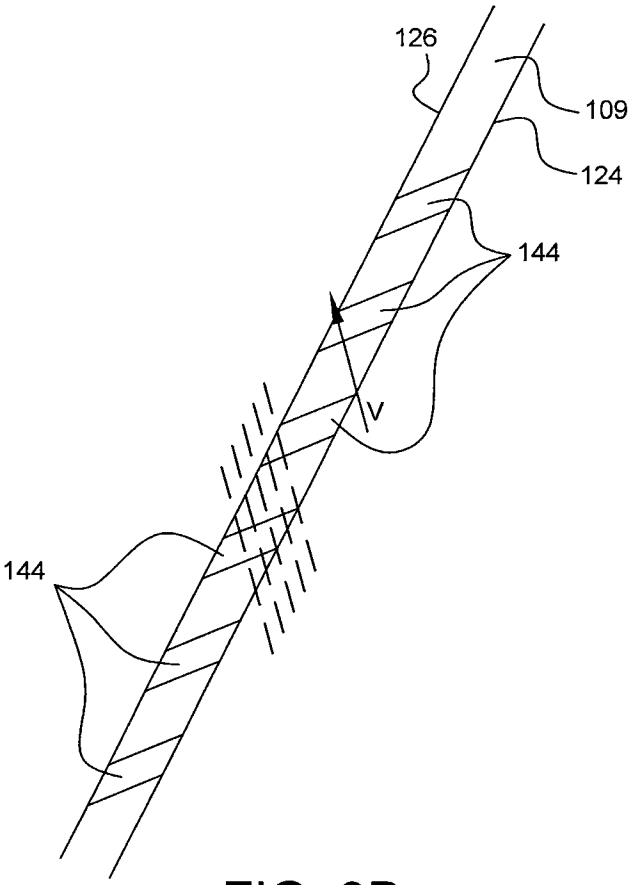

FIG. 9B is a profile view of a portion of a blade tip 109 having a plurality of sealing members 144 extending therefrom. As shown in FIG. 9B, sealing members 144 may be spaced between the leading edge 128 and the trailing edge 130 of the blade tip 109 to effect overlap of adjacent sealing members 144 in the direction of the air flow. In other words, any leakage stream contacting the pressure side surface 124 at the leakage vector or direction indicated by arrow V will be blocked from reaching the suction side surface 126 by at least one sealing member 144 and, due to the overlap of adjacent sealing members 144, may be blocked by more than one sealing member 144. Chord-wise spacing of the sealing members 144 is sufficient to present an overlapping geometry to the primary direction of tip leakage air flow at operating conditions.

In some embodiments, the angle of each sealing member 144 may be measured relative to the axis of rotation of the turbine engine, fan, compressor, and/or turbine. In some embodiments, each sealing member 144 is positioned along the blade tip 109 to have a unique angle compared with other sealing members 144 positioned along that blade tip 109. The angle may be measured relative to a leakage vector or the axis of rotation. In some embodiments, one or more sealing members 144 positioned along the blade tip 109 may have an angle that is different from the angle of another sealing member 144 positioned along that blade tip 109. The angle may be measured relative to a leakage vector or the axis of rotation.

In some embodiments the angle of each sealing member 144 positioned along the blade tip 109 is adjusted to be perpendicular to the direction of primary leakage at that particular chord-wise position. Similarly, in some embodiments the shape of each sealing member 144 positioned along the blade tip 109 is optimized based on the direction of primary leakage at that particular chord-wise position.

The present disclosure additionally provides methods for reducing or eliminating leakage through the blade tip clearance 105 in a fan, compressor, or turbine of a turbine engine. A primary direction of tip leakage air flow is determined relative to a blade tip chord. A blade tip platform is positioned over the blade tip. As described above, the blade tip platform 142 has a surface 143 facing the casing 103 and extending between the distal edges of the pressure side 124 and suction side 126 of blade 101, as well as between the leading edge 128 and trailing edge 130 of blade 101. A plurality of sealing members 144 are positioned on the surface 143 of the blade tip platform 142. As described above, the sealing members 144 may be positioned at an angle substantially perpendicular to the primary direction of tip leakage air flow. Sealing members 144 may also be spaced along the blade tip chord to effect overlap of adjacent sealing members 144 in the direction of the tip leakage air flow.

In another method of the present disclosure, the method comprises positioning a blade tip platform over the blade tip, positioning a plurality of elongated sealing members on the surface of the blade tip platform, and rotating the rotor or effect rub between the plurality of sealing members and the abradable region. As discussed above, the blade tip platform having a surface facing the abradable region of the casing and extending at least between the distal edges of the pressure side and suction side of the blade and between the leading edge and trailing edge of the blade. The sealing members are dimensioned such that at least a portion of each sealing member contacts the abradable region. The rub of sealing members against the abradable region 155 causes a plurality of annular channels to be formed in the abradable region with each one of said plurality of annular channels corresponding to a respective one of said plurality of sealing members.

In some embodiments the method further includes determining a primary direction of the tip leakage air flow relative to a blade tip chord. In some embodiments the method further includes positioning the plurality of elongated sealing members on the surface of the blade tip platform at an angle substantially perpendicular to the primary direction of the tip leakage air flow. In some embodiments the method further includes positioning the plurality of elongated sealing members on the surface of the blade tip platform at a spacing along the blade tip chord to effect overlap of adjacent sealing members in the direction of the tip leakage air flow.

In still another method of the present disclosure of reducing blade tip clearance leakage, the method comprises positioning a blade tip platform over the blade tip, positioning a plurality of elongated sealing members on the surface of the blade tip platform, determining the flow rate and direction of the tip leakage airflow, and varying one or more of the selected lateral cross-sectional shape, the selected angle relative to the blade tip chord, and the selected chord-wise spacing pattern to effect a change in the flow rate of the tip leakage air flow.

As described above, the blade tip platform has a surface facing the casing and extending at least between the distal edges of the pressure side and suction side of the blade and between the leading edge and trailing edge of the blade. The plurality of elongated sealing members that are positioned on the blade tip platform before the step of determining flow rate and direction of the tip leakage airflow have a selected lateral cross-sectional shape, are positioned at a selected angle relative to the blade tip chord, and are spaced in a selected chord-wise spacing pattern along the blade tip chord.

The present disclosure provides systems and methods for reducing leakage through the blade tip clearance 105. The disclosure is applicable to fan, compressor, and turbine blades of a turbine engine. In some embodiments, the present disclosure may be applied to certain stages of a compressor or turbine but not to all stages. The advantages realized by the present disclosure are most advantageous in compressor blade systems, where the clearance to span ratio is more favorable for the benefit. For example, at higher clearance to span ratios the importance of reducing leakage is increased.

The present disclosure provides many advantages over previous blade and blade tip clearance designs. Most notably, the present disclosure significantly reduces or even eliminates leakage across the blade tip clearance. Decreasing such leakage improves efficiency of the associated fan, compressor, or turbine and may increase stall margin as well. Decreasing blade tip clearance leakage also allows for consideration and optimization of other design factors to meet various aero and mechanical requirements.

Although examples are illustrated and described herein, embodiments are nevertheless not limited to the details shown, since various modifications and structural changes may be made therein by those of ordinary skill within the scope and range of equivalents of the claims.

What is claimed is:

1. A rotor assembly comprising:

a casing;

a rotor encased by said casing;

and at least one rotor blade coupled to said rotor, each of said at least one rotor blade comprising:

a root portion coupled to said rotor;

a main airfoil body extending radially from said root portion, said airfoil body comprising a pressure side surface and a suction side surface joined at and extending between a leading edge and a trailing edge; and a blade tip sealing portion forming a distal end of said at least one rotor blade, said blade tip sealing portion comprising:

a blade tip platform facing said casing and extending at least between distal edges of said pressure side surface and said suction side surface of said main airfoil body and extending axially from a front edge proximate the leading edge to a rear edge proximate the trailing edge;

a plurality of sealing members extending radially from said blade tip platform, said sealing members being positioned on said blade tip platform to extend between a pressure side edge and a suction side edge of said blade tip platform at an angle perpendicular to an air flow across said blade tip platform and being spaced between said leading edge and said trailing edge of said main airfoil body to effect overlap of adjacent sealing members in the direction of the air flow; and the plurality of sealing members being positioned to effect greater spacing between ones of a set of the plurality of sealing members nearer the leading edge or trailing edge of the respective at least one rotor blade than between ones of another set of the plurality of sealing members nearer a mid-chord of the respective at least one rotor blade, wherein an angle of a first one of said plurality of sealing members relative to an axis of rotation of the rotor assembly differs from an angle of a second one of said plurality of sealing members relative to the axis of rotation of the rotor assembly.

2. A rotor assembly comprising:

a casing;

a rotor encased by said casing; and at least one rotor blade coupled to said rotor, each of said at least one rotor blade comprising:

a root portion coupled to said rotor;

a main airfoil body extending radially from said root portion, said airfoil body comprising a pressure side surface and a suction side surface joined at and extending between a leading edge and a trailing edge; and a blade tip sealing portion forming a distal end of said at least one rotor blade, said blade tip sealing portion comprising:

a blade tip platform facing said casing and extending at least between distal edges of said pressure side surface and said suction side surface of said main airfoil body and extending axially from a front edge proximate the leading edge to a rear edge proximate the trailing edge;

a plurality of sealing members extending radially from said blade tip platform, said sealing members being positioned on said blade tip platform to extend between a pressure side edge and a suction side edge of said blade tip platform at an angle perpendicular to an air flow across said blade tip platform and being spaced between said leading edge and said trailing edge of said main airfoil body to effect overlap of adjacent sealing members in the direction of the air flow; and the plurality of sealing members being positioned to effect greater spacing between ones of a set of the plurality of sealing members nearer a mid-chord of the respective at least one rotor blade than between ones of another set of the plurality of sealing members nearer the leading edge or trailing edge of the respective at least one rotor blade, wherein an angle of a first one of said plurality of sealing members relative to an axis of rotation of the rotor assembly differs from an angle of a second one of said plurality of sealing members relative to the axis of rotation of the rotor assembly.

3. The rotor assembly of claim 2 wherein the plurality of sealing members have a uniform radial dimension.

4. The rotor assembly of claim 2 wherein the plurality of sealing members have a differing radial dimension.

5. The rotor assembly of claim 2 wherein each of the plurality of sealing members have a varying radial dimension along a length thereof.

6. A rotor assembly comprising:

a casing;

a rotor encased by said casing; and at least one rotor blade coupled to said rotor, each of said at least one rotor blade comprising:

a root portion coupled to said rotor;

a main airfoil body extending radially from said root portion, said airfoil body comprising a pressure side surface and a suction side surface joined at and extending between a leading edge and a trailing edge; and a blade tip sealing portion forming a distal end of said at least one rotor blade, said blade tip sealing portion comprising:

a blade tip platform facing said casing and extending at least between distal edges of said pressure side surface and said suction side surface of said main airfoil body and extending axially from a front edge proximate the leading edge to a rear edge proximate the trailing edge;

a plurality of sealing members extending radially from said blade tip platform, said sealing members being positioned on said blade tip platform to extend between a pressure side edge and a suction side edge of said blade tip platform at an angle perpendicular to an air flow across said blade tip platform and being spaced between said leading edge and said trailing edge of said main airfoil body to effect overlap of adjacent sealing members in the direction of the air flow; and the plurality of elongated sealing members are positioned to effect non-uniform spacing between ones of a set of the plurality of sealing members nearer the leading edge or the trailing edge of the respective at least one rotor blade than between ones of another set of the plurality of sealing members nearer a mid-chord of the respective at least one rotor blade, wherein an angle of a first one of said plurality of sealing members relative to an axis of rotation of the rotor assembly differs from an angle of a second one of said plurality of sealing members relative to the axis of rotation of the rotor assembly.

7. In a rotor assembly having a casing, a rotor encased by the casing, and a rotor blade coupled to the rotor having a blade tip spaced from the casing, a method of reducing a tip leakage air flow between the blade tip and the casing from a pressure side of the rotor blade to a suction side of the rotor blade during rotation of the rotor, said method comprising:

determining a primary direction of the tip leakage air flow relative to a blade tip chord; and positioning a plurality of elongated sealing members on a radially outward facing surface of the blade tip, the plurality of elongated sealing members being positioned at an angle perpendicular to the primary direction of the tip leakage air flow and being spaced along the blade tip chord to effect overlap of adjacent sealing members in the direction of the tip leakage air flow;

wherein the plurality of elongated sealing members are positioned to effect non- uniform spacing between ones of a set of the plurality of elongated sealing members nearer a leading edge or a trailing edge of the respective at least one rotor blade than between ones of another set of the plurality of sealing members nearer a mid-chord of the respective at least one rotor blade, wherein an angle of the a first one of said plurality of sealing members relative to an axis of rotation of the rotor assembly differs from an angle of a second one of said plurality of sealing members relative to the axis of rotation of the rotor assembly.

8. The method of claim 7 wherein the plurality of elongated sealing members are positioned to effect greater spacing between ones of a set of the plurality of elongated sealing members nearer the leading edge or the trailing edge of the rotor blade than between ones of another set of the plurality of elongated sealing members nearer the mid-chord of the rotor blade.

9. The method of claim 7 wherein the plurality of elongated sealing members are positioned to effect greater spacing between ones of a set of the plurality of elongated sealing members nearer the mid-chord of the rotor blade than between ones of another set of the plurality of elongated sealing members nearer the leading edge or trailing edge of the rotor blade.

10. The method of claim 7 wherein the plurality of elongated sealing members have a uniform radial dimension.

11. The method of claim 7 wherein the plurality of elongated sealing members have a differing radial dimension.

12. The method of claim 7 wherein the plurality of elongated sealing members each have a varying radial dimension along a length thereof.

13. The method of claim 7 comprising:

providing an abradable region on the casing adjacent the blade tip;

dimensioning the plurality of elongated sealing members in the radial direction to effect contact between at least a portion of each of the plurality of elongated sealing members and the abradable region; and rotating the rotor to effect rub between the plurality of elongated sealing members and the abradable region, wherein said rub causes a plurality of annular channels to be formed in the abradable region with each one of said plurality of annular channels corresponding to a respective one of said plurality of elongated sealing members.

14. In a rotor assembly having a casing, a rotor encased by the casing, and a rotor blade coupled to the rotor having a blade tip spaced from the casing, a method of reducing a tip leakage air flow between the blade tip and the casing from a pressure side of the rotor blade to a suction side of the rotor blade during rotation of the rotor, said method comprising:

determining a flow rate and direction of the tip leakage airflow;

positioning a blade tip platform over the blade tip, the blade tip platform having a surface facing the casing and extending at least between distal edges of the pressure side and suction side of the blade and between a leading edge and a trailing edge of the blade;

positioning a plurality of elongated sealing members on the surface of the blade tip platform having a selected lateral cross-sectional shape, the plurality of elongated sealing members being positioned at a selected angle relative to a blade tip chord and being spaced in a selected chord-wise spacing pattern along the blade tip chord; wherein an angle of a first one of said plurality of sealing members relative to an axis of rotation of the rotor assembly differs from an angle of a second one of said plurality of sealing members relative to the axis of rotation of the rotor assembly; and wherein one or more of the selected lateral cross-sectional shape of ones of the plurality of elongated sealing members, the selected angle of ones of the plurality of elongated sealing members relative to the blade tip chord, and the selected chord-wise spacing pattern between ones of a set of the plurality of elongated sealing members is different from the selected lateral cross-sectional shape of other ones of the plurality of elongated sealing members, the selected angle of other ones of the plurality of elongated sealing members relative to the blade tip chord, and the selected chord-wise spacing pattern between ones of a set of the plurality of elongated sealing members to effect a change in the flow rate of the tip leakage air flow.

* * * * *